US007662209B2

(12) United States Patent
Kejzelman et al.

(10) Patent No.: US 7,662,209 B2
(45) **Date of Patent: *Feb. 16, 2010**

(54) IRON-BASED POWDER

(75) Inventors: Mikhail Kejzelman, Malmö (SE); Paul Skoglund, Höganäs (SE); Hilmar Vidarsson, Höganäs (SE); Per Knutsson, Ängelholm (SE)

(73) Assignee: Höganäs AB, Höganäs (SE)

( * ) Notice: Subject to any disclaimer, the term of this patent is extended or adjusted under 35 U.S.C. 154(b) by 0 days.

This patent is subject to a terminal disclaimer.

(21) Appl. No.: 11/806,813

(22) Filed: Jun. 4, 2007

(65) Prior Publication Data

US 2007/0234850 A1 Oct. 11, 2007

Related U.S. Application Data

(63) Continuation of application No. 10/689,688, filed on Oct. 22, 2003, now Pat. No. 7,238,220.

(60) Provisional application No. 60/477,947, filed on Jun. 13, 2003.

(30) Foreign Application Priority Data

Oct. 22, 2002 (SE) ..... 0203133

(51) Int. Cl.
*B22F 1/02* (2006.01)
*B22F 3/00* (2006.01)

(52) U.S. Cl. ..... 75/252; 419/66

(58) Field of Classification Search ..... 75/252; 419/66

See application file for complete search history.

(56) References Cited

U.S. PATENT DOCUMENTS

| | | | | |
|---|---|---|---|---|
| 3,600,210 | A | 8/1971 | Alessi | |
| 3,901,661 | A | 8/1975 | Kondo et al. | |
| 4,190,441 | A | 2/1980 | Tengzelius et al. | |
| 4,689,181 | A | 8/1987 | Blatch | |
| 5,541,249 | A | 7/1996 | Hughes et al. | |
| 5,892,164 | A | 4/1999 | Garg et al. | |
| 6,139,600 | A | 10/2000 | Ozaki et al. | |
| 6,235,076 | B1 | 5/2001 | Ozaki et al. | |
| 6,451,082 | B1 | 9/2002 | Ozaki et al. | |
| 6,503,445 | B2 | 1/2003 | Ozaki et al. | |
| 6,558,565 | B1 | 5/2003 | Matsutani et al. | |
| 7,419,527 | B2 * | 9/2008 | Gwozdz et al. | 75/252 |
| 2003/0077448 | A1 | 4/2003 | Ueta et al. | |

FOREIGN PATENT DOCUMENTS

| | | |
|---|---|---|
| CA | 2 381 507 | 10/2002 |
| EP | 0 554 009 | 8/1993 |
| GB | 2315115 | 1/1998 |
| JP | 2002212462 | 7/2002 |

* cited by examiner

*Primary Examiner*—Roy King
*Assistant Examiner*—Ngoclan T Mai
(74) *Attorney, Agent, or Firm*—Buchanan Ingersoll & Rooney PC

(57) ABSTRACT

The invention concerns a powder composition including an iron or iron based powder and a lubricating amount of an alkylalkoxy or polyetheralkoxy silane, wherein the alkyl or polyether group has between 8 and 30 carbon atoms and the alkoxy group includes 1-3 carbon atoms.

7 Claims, 3 Drawing Sheets

Example 1
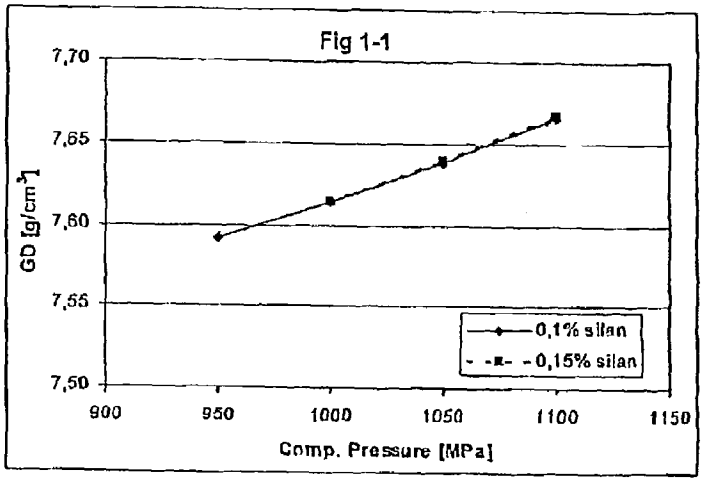
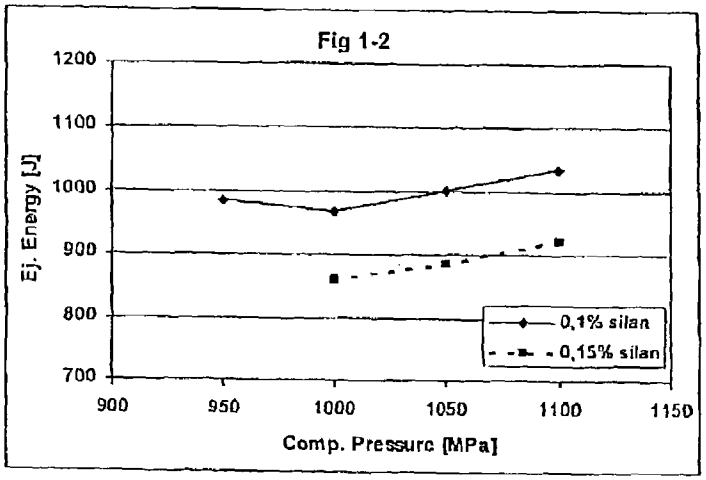

Example 2
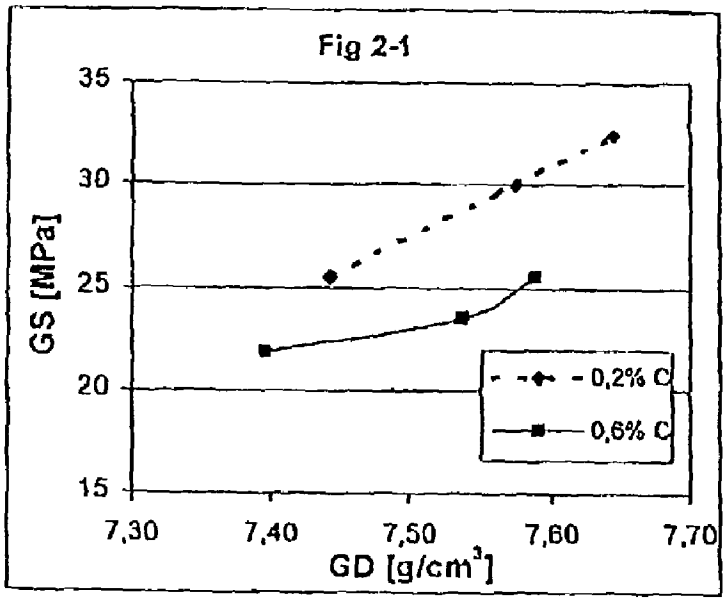
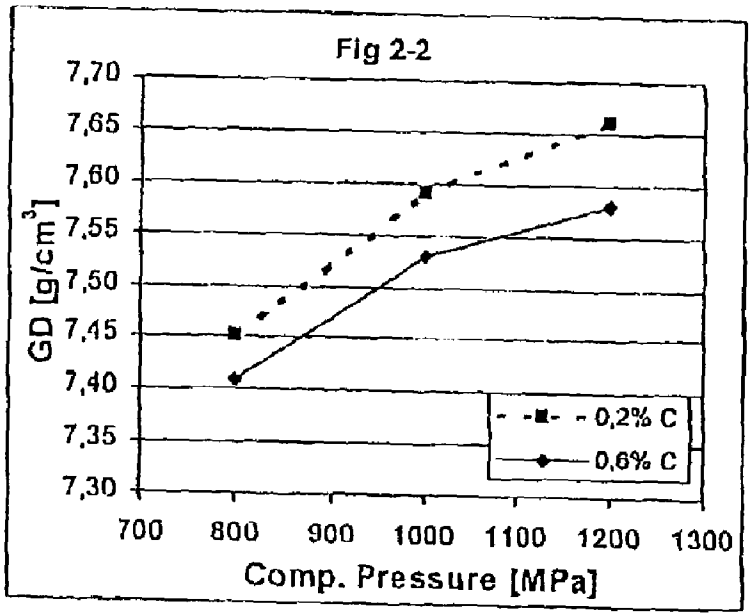

Example 3
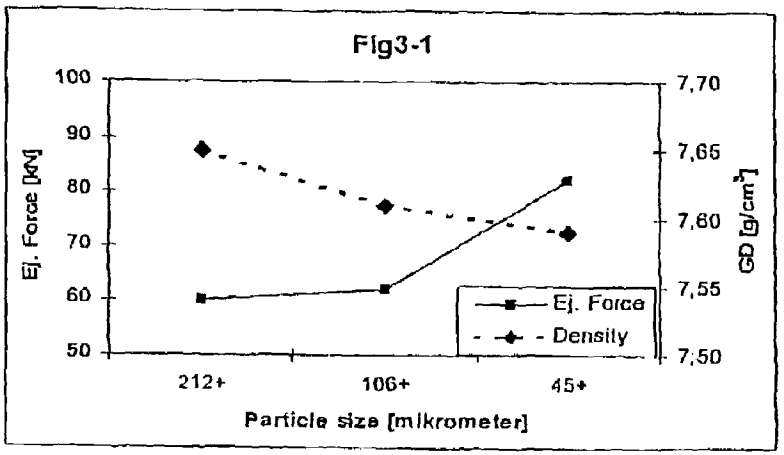
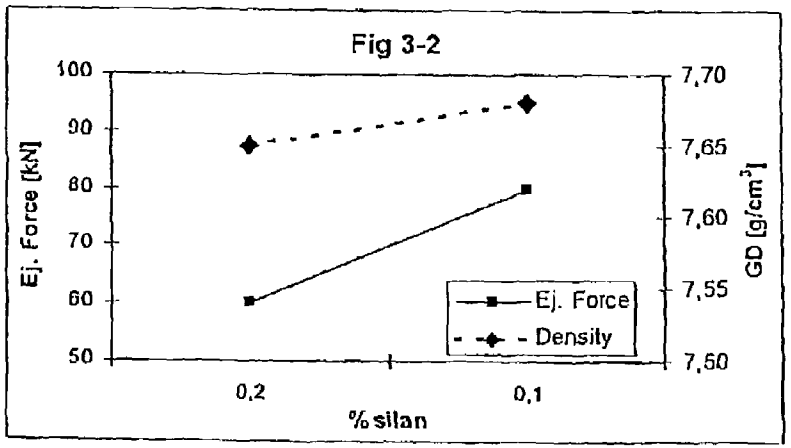

IRON-BASED POWDER

This is a Continuation of U.S. patent application Ser. No. 10/689,688, filed Oct. 22, 2003, now U.S. Pat. No. 7,238,220 and priority is claimed under 35 U.S.C. § 119(a) for the filing of Swedish Application No. 0203133-4, filed Oct. 22, 2002, and under 35 U.S.C. §119(e) for the filing of U.S. Provisional Patent Application No. 60/477,947 on Jun. 13, 2003.

FIELD OF THE INVENTION

The present invention relates to new metal powder compositions useful within the powder metallurgical industry. The invention also concerns a method for the preparation of high density metal components by using these compositions.

There are several advantages by using powder metallurgical methods for producing structural parts compared with conventional matching processes of full dense steel. Thus, the energy consumption is much lower and the material utilisation is much higher. Another important factor in favour of the powder metallurgical route is that components with net shape or near net shape can be produced directly after the sintering process without costly shaping processes, such as turning, milling, boring or grinding. However, normally a full dense steel material has superior mechanical properties compared with PM components. This is mainly due to the occurrence of porosity in the PM components. Therefore, the strive has been to increase the density of PM components in order to reach values as close as possible to the density value of a full dense steel.

Among the methods used in order to reach higher density of PM components the powder forging process has the advantage that full dense components may be obtained. The process is however costly and is utilised mainly for mass production of heavier components, such as connection rods. Full dense materials can also be obtained by elevated pressures at high temperatures, such as in hot isostatic pressing, HIP, but also this method is costly.

By using warm compaction, a process where the compaction is performed at an elevated temperature, typically at 120 to 250° C., the density can be increased with about 0.2 g/cm$^3$, which results in a considerable improvement of the mechanical properties. A disadvantage is however that the warm compaction method involves additional investment and processing. Other processes, such as double pressing, double sintering, sintering at elevated temperatures etc, may further increase the density. Also these methods will add further production costs hence reducing the overall cost effectiveness.

In order to expand the market for powder metallurgical components and utilise the advantages with the powder metallurgical technique there is thus a need for a simple, less expensive method of achieving high density compacts with improved mechanical properties.

SUMMARY OF THE INVENTION

It has now unexpectedly been found that high density components can be obtained by using high compaction pressures in combination with a new type of powder compositions. Distinguishing features of these compositions are that less than about 5% of the particles of the iron or iron-based powder have a size below 45 μm and that the compositions include a lubricating amount of an alkylalkoxy or polyetheralkoxy silane. The present invention also includes a method of preparing green and optionally sintered compacts from these compositions. This method comprises the steps of providing the composition, optionally mixing said composition with graphite and other additives such as alloying elements, machinability improving agents etc; uniaxially compacting the composition in a die at high pressure and ejecting the green body, which may subsequently be sintered.

Another aspect of the invention concerns compositions with this type of silanes in combination with iron or iron based powders irrespective of particle size i.e. in combination with powders conventionally used. Also in this case quite high densites may be obtained.

BRIEF DESCRIPTION OF THE DRAWINGS

FIG. 1-1 is a graph showing green density of compacts prepared from compositions containing 0.15% silane and 0.1% silane at different compaction pressures.

FIG. 1-2 is a graph showing ejection energy needed for compacts prepared from compositions containing 0.15% silane and 0.1% silane.

FIG. 2-1 is a graph showing green strength of the compacts prepared from compositions containing 0.2% graphite and 0.6% graphite.

FIG. 2-2 is a graph showing green density of the compacts prepared from compositions containing 0.2% graphite and 0.6% graphite.

FIG. 3-1 is a graph showing green densities increased and the ejection forces decreased with increasing particles sizes.

FIG. 3-2 is a graph showing the ejection forces decrease when the amount of silane is increased from 0.1% to 0.2% by weight.

DETAILED DESCRIPTION OF THE INVENTION

The term "high density" is intended to mean compacts having a density of about at least 7.3 g/cm$^3$. "High density" is not an absolute value. A typical achievable density according to the state of the art for single pressed, single sintered components is about 7.1 g/cm$^3$. By using warm compaction an increase of about 0.2 g/cm$^3$ may be reached.

In this context the term "high density" is intended to mean compacts having a density of about 7.35-7.65 g/cm$^3$ and above, depending of type and amount of additives used, and type of iron-based powder used. Components having lower densities can of course also be produced but are believed to be of less interest.

The iron-based powder according to the present invention includes pure iron powder, such as water or gas atomised iron powder, sponge iron powders, reduced iron powder; partially diffusion-alloyed steel powder; and completely alloyed steel powder. The partially diffusion-alloyed steel powder is preferably a steel powder alloyed partially with one or more of Cu, Ni, Mo. The completely alloyed steel powder is preferably a steel powder alloyed with Mn, Cu, Ni, Cr, Mo, V, Co, W, Nb, Ti, Al, P, S and B. Also stainless steel powders are of interest.

As regards the particle shape it is preferred that the particles have an irregular form as is obtained by water atomisation. Also sponge iron powders have irregularly shaped particles and may be of interest.

One feature of the invention is that the powder used have coarse particles i.e. the powder is essentially without fine particles. The term "essentially without fine particles" is intended to mean that less than about 5% of the iron or iron-based powder particles have size below 45 μm as measured by the method described in SS-EN 24 497. So far the most interesting results have been achieved with powders essentially consisting of particles above about 106 μm and particularly above about 212 μm. The term "essentially consisting" is intended to mean that at least 40%, preferably at least 60% of the particles have a particle size above 106 and 212 μm, respectively. So far the best results have been obtained with powders having an average particle size above about 212 μm and only less than 5% below 212 μm. The maximum particle size may be about 2 mm. The particle size distribution for iron-based powders used at PM manufacturing is normally distributed with a gaussian distribution with a average particle diameter in the region of 30 to 100 μm and about 10-30% less than 45 μm. Iron based powders essentially free from fine particles may be obtained by removing the finer fractions of the powder or by manufacturing a powder having the desired particle size distribution.

The influence of particle size distribution and the influence of particle shape on the compaction properties and properties of the compacted body have been subjected to intense studies. Thus the U.S. Pat. No. 5,594,186 reveals a method of producing PM components with a density higher than 95% of theoretical density by utilising substantially linear, acicular metal particles having a triangular cross section. Powders having coarse particles are also used for the manufacture of soft magnetic components as disclosed in e.g., U.S. Pat. Nos. 6,309,748 and 4,190,441.

A critical feature according to the invention in order to obtain the high density products is the type and amount of lubricant. It has thus been found that a specific type of lubricants which has previously not been used in connection with metal powders give very promising results. These lubricants belongs to the group of alkylalkoxy or polyether silanes and more specifically alkylalkoxy or polyether silanes wherein at least one substituent on the Si atom is an alkyl group having at least 8 carbon atoms, wherein the alkyl group may be interrupted by one or more O atoms. The compounds wherein the alkyl group includes one or more oxygen atoms used according to the present invention are called polyether silanes The chain length of the alkyl or polyether group is an important feature of the silanes used according to the present invention and have an influence on the lubricating properties of the silane. So far it has been found that the most interesting results are obtained with alkyl or polyether chains having between 8 and 30, preferably between 10 and 24 carbon atoms. Preferably the silane is selected form the group consisting of octyltri-metoxy silane, hexadecyl-tri-metoxy silane and polyethyleneether-trimetoxy silane with 10 ethyleneether groups.

In this context it may be mentioned that U.S. Pat. Nos. 5,766,304, 5,989,304, 6,139,600, 6,235,076 and 6,451,082 disclose that very small amounts, i.e. 0.05 or less % by weight of the total composition to be compacted, of organoalkoxysilanes may be used as surface treating agents for iron or iron-based powder in combination with lubricating agents. In the four first U.S. patents the following silane compounds are tested: γ-methacryloxypropyl trimethoxy silane, γ-glycidoxypropyl trimethoxy silane, N-beta.(aminoethyl)-γ-trimethoxy silane, methyl trimethoxy silane, fenyl trimethoxy silane and diphenyl dimethoxy silane) In U.S. Pat. No. 6,451,082 the compounds triphenylmethoxysilane, diphenyldimethoxysilane, phenyltrimeth-oxysilane, isobutyltrimethoxysilane, and methyltriethoxysilane have been used. The type of organosilanes with lubricating effect used according to the present invention are thus neither mentioned nor tested.

The organosilane with lubricating effect used according to the present invention is preferably used in such a way that it is dissolved or dispersed in a suitable solvent, e.g. an organic solvent, such as acetone or ethanol. The obtained solution or dispersion is subsequently added to the iron based powder during mixing and optionally heating. The solvent is finally evaporated optionally in vacuum.

According to a preferred embodiment of the invention and contrary to common practise in powder metallurgy, where conventional PM lubricants are used in the iron powder mix, or where a lubricant is used in combination with binder and/or surface treatments, such as described in U.S. Patents referred to above, the iron or iron based powder must not be mixed with a separate (conventional) lubricant before it is transferred to the die. Nor is it necessary to use external lubrication (die wall lubrication) where the walls of the die are provided with a lubricant before the compaction is performed. The invention however does not exclude the possibility of, when it is of interest to utilise conventional internal lubrication (in an amount up to 0.5% by weight), external lubrication or a combination of both For some applications it may be necessary to add minor amounts of graphite to the powder mixture to be compacted. Thus graphite in amounts between 0.1-1.0, preferably 0.2-1.0 and most preferably 0.3-0.8% by weight of the total mixture to be compacted should be added before the compaction.

Other additives which may be added to the iron-based powder before compaction such as alloying elements comprising Mn, Cu, Ni, Cr, Mo, V, Co, W, Nb, Ti, Al, P, S and B machinability enhancing compounds, hard phase material and flow agents.

The term "at high compaction pressure" is intended to mean at pressures of about at least 800 MPa. More interesting results are obtained with higher pressures such as pressures above 900, preferably above 1000, more preferably above 1100 MPa. Conventional compaction at high pressures, i.e. pressures above about 800 MPa with conventionally used powders including finer particles, are generally considered unsuitable due to the high forces required in order to eject the compacts from the die, the accompanying high wear of the die and the fact that the surfaces of the components tend to be less shiny or deteriorated. By using the powders according to the present invention it has unexpectedly been found that the ejection force is reduced at high pressures, about 1000 MPa, and that components having acceptable or even perfect surfaces may be obtained.

The compaction may be performed with standard equipment, which means that the new method may be performed without expensive investments. The compaction is performed uniaxially and preferably in a single step at ambient or elevated temperature. Alternatively the compaction may be performed with the aid of a percussion machine (Model HYP 35-4 from Hydropulsor) as described in patent publication WO 02/38315.

The sintering may be performed at the temperatures normally used within the PM field, e.g. at low temperature such as 1100-1140° C. or higher temperatures such as 1200-1300° C. and in conventionally used atmospheres or vacuum.

Other treatments of the green or sintered component may as well be applied, such as green machining, case hardening, surface densification, steam treatment.

In brief the advantages obtained by using the method according to the present invention are that high density green compacts can be cost effectively produced. The new method also permits production of higher components which are difficult to produce by using the conventional technique. Additionally standard compaction equipment can be used for producing high density compacts having acceptable or even perfect surface finish.

Examples of products, which suitably can be manufactured by the new method, high performance structural parts such as connecting rods, cam lobes, gears and other structural components subjected to high loads. By using stainless steel powders flanges are of special interest.

As a main object of the present invention is to achieve high density products the silanes having lubricating effect have been described particularly in connection with coarse powders. It has however also been found that these silanes may also be used in combination with powder including higher amounts of fine particles i.e. the type of powders which are conventionally used in the PM industry today. Example 4 below illustrates the effect of the silanes according to the present invention on both conventional powders and coarse powders. As can be seen very high densities are obtained also with a conventional powder including higher amounts of fine particles. Compositions including iron or iron-based powders with the usual particle size distributions and the silanes according to the present invention may be of special interest for certain applications and are also within the scope of the invention.

The invention is further illustrated by the following examples.

EXAMPLE 1

Iron-based powder composition prepared from AstaloyMo, which is a prelloyed iron based powder alloyed with 1.5% by weight of molybdenum available from Höganäs AB, Sweden, and where particles less than 212 μm had been eliminated was mixed with 0.1 and 0.15%, respectively, of hexadecyl trimethoxy silane. The mixing process was performed as follows: hexadecyl trimethoxy silane was diluted in ethanol to a 20% solution, by weight, and the solution was stirred during 60 minutes. An amount of this solution corresponding to 0.1 and 0.15% by weight, respectively, was added during mixing to the iron based powder mixtures, which had previously been heated to 75° C. in the mixer. An intensive mixing was carried out in the same mixer during 3 minutes followed by mixing at a lower speed during 30 minutes and during vacuum in order to evaporate the solvent. The obtained mixture was sieved with a 500 μm sieve.

Rings with an inner diameter of 35 mm and an outer diameter of 14 mm and a height of 10 mm were uniaxially compacted in a single step at different compaction pressures. As can be seem from FIG. 1-1 green densities of 7.67 g/cm$^3$ were obtained at a pressure of 1100 MPa for both compositions. The total energy needed for ejection is somewhat lower for the compacts prepared from the composition with 0.15% of silane than for ejection of the compacts prepared from the powder which had been treated with 0.1% by weight of silane, see FIG. 1-2.

EXAMPLE 2

The same powder and the same procedure as in Example 1 was used except that the powder was mixed with 0.2% by weight of hexadecyl trimethoxy silane. Two compositions were prepared, one with 0.2% by weight of graphite and the other with 0.6% by weight of graphite. The green density and the green strength were measured.

As can be seen from FIG. 2-2 a green density above 7.65 g/cm$^3$ was obtained for a green component containing 0.2% graphite compacted at 1200 MPa. For a green component containing 0.6% graphite a green density of 7.58 g/cm3 was obtained.

FIG. 2-1 shows that the green strength increases with increasing compaction pressure and that the green strength is high enough to allow handling of the green components.

EXAMPLE 3

This example shows the effect of the eliminating different fractions of the iron based powder four different iron based powder compositions were tested. Three of the iron based powder compositions contained Astaloy Mo including 0.2% hexadecyl trimethoxy silane and the mixing procedure in example 1 was used. The first composition contained Astaloy Mo coarser than 45μm, the second composition contained Astaloy Mo coarser than 106 μm and the third composition contained Astaloy Mo coarser than 212 μm. The fourth composition contained Astaloy Mo having particles coarser than 212 μm. The particles of this composition were mixed with 0.1% by weight of hexadecyl trimethoxysilane. Further, all compositions contained 0.2% of graphite. All compositions were uniaxially compacted in a single step in a die forming rings with an outer diameter of 35 mm, inner diameter of 14 mm and a height of 10 mm.

FIG. 3-1 shows that the green densities increased and the ejection forces decreased with increasing particles sizes.

FIG. 3-2 shows that the ejection forces decrease when the amount of silane is increased from 0.1 to 0.2% by weight.

EXAMPLE 4

This example demonstrates the effect of the chain length of the alkyl or polyether group, the particle size distribution and the added amount off silanes on the lubricating properties at ejection after compaction with high pressures. Two kinds of powder were used, namely a standard 100 mesh iron-based powder, Astaloy 85 Mo with about 20% of the particles less than 45 μm (S-powder) and a powder having the same chemical composition without fine particles and a weight average particle size of about 212 μm, (C-powder).

Five different kinds of silanes were used according to table a)

A Methyl-tri-methoxy silane
B Propyl-tri-metoxy silane
C Octyl-tri-metoxy silane
D Hexadecyl-tri-metoxy silane
E Polyethyleneether-trimetoxy silane with 10 ethylene ether groups Different content of silanes were added to the iron-based powder and the obtained mixtures were compacted at 1100 MPa in a uniaxial press movement into slugs with a diameter of 25 mm and a height of 12 mm. During ejection the dynamic ejection force was measured and after ejection green surface finish were evaluated and density were measured as shown in table.

| | Powder C | Powder C | Powder C | Powder C | Powder S | Powder C | Powder S | Powder C | Powder S | Powder S |
|---|---|---|---|---|---|---|---|---|---|---|
| Silane | 0.03% | 0.05% | 0.1% | 0.2% | 0.2% | 0.3% | 0.3% | 0.4% | 0.4% | 0.5% |
| E | Seizure | 62 kN | 39 kN | 39 kN | 65 kN | 33 kN | 38 kN | | | |
| | | OK | OK | OK | OK | OK | OK | | | |
| | | 7.67 g/cm$^3$ | 7.66 g/cm$^3$ | 7.67 g/cm$^3$ | 7.61 g/cm$^3$ | 7.66 g/cm$^3$ | 7.63 g/cm$^3$ | | | |

-continued

| | Powder C | Powder C | Powder C | Powder C | Powder S | Powder C | Powder S | Powder C | Powder S | Powder S |
|---|---|---|---|---|---|---|---|---|---|---|
| D | | | 48 kN<br>OK<br>7.65<br>g/cm$^3$ | 46 kN<br>OK<br>7.66<br>g/cm$^3$ | 47 kN<br>OK<br>7.63<br>g/cm$^3$ | 36 kN<br>OK<br>7.64<br>g/cm$^3$ | 34 kN<br>OK<br>7.62<br>g/cm$^3$ | | | 29 kN<br>OK<br>7.56<br>g/cm$^3$ |
| C | | | | | | Seizure | | 37 kN<br>OK<br>7.60<br>g/cm$^3$ | 66 kN<br>OK<br>7.60<br>g/cm$^3$ | 97 kN*<br>OK<br>7.53<br>g/cm$^3$ |
| B | | | | | | Seizure | | | | |
| A | | | | | | Seizure | | | | |

*unstable value (OK = fine/satisfactory surface finish; seizure - seized component surface with scoring marks)

As can be seen from the table a chain length of at least 8 atoms in the alkylene chain is needed in order to successfully eject the component for an added amount of silanes of 0.05-0.5%. Added amounts above 0.5% is believed to be of less interest as the density of the green component while be negatively influenced. The table also shows that when the silane content is less than 0.05% ejection without damaging the component and the surface of the die is not possible for silanes with a chain length of 30 atoms.

From the table below it can also be concluded that also powder with a standard particle size distribution can be compacted to high densities of 7.60 g/cm$^3$ and above, and successfully ejected, provided the amount of added silane is less than 0.5% and the length of the above alkylene or poly ethylenether chain is above 8 atoms.

We claim:

1. A powder composition for the preparation of compacted and sintered structural parts, the powder composition comprising:

an iron or iron-based powder;

graphite in an amount of 0.1% to 1% by weight, and a lubricating amount of an alkylalkoxy or polyetheralkoxy silane, wherein the alkylalkoxy or polyetheralkoxy silane is selected from the group consisting of octyl-tri-methoxy silane, hexadecyl-tri-methoxy silane, and polyethyleneether-trimethoxy silane with 10 ethylene ether groups.

2. The powder composition of claim 1, wherein the alkoxy or polyetheralkoxy silane is present in an amount of about 0.05-0.5% by weight.

3. The powder composition of claim 1, wherein the alkylalkoxy or polyetheralkoxy silane is present in an amount of about 0.1-0.4% by weight.

4. The powder composition of claim 1, wherein the alkylalkoxy or polyetheralkoxy silane is present in an amount of about 0.15-0.3% by weight.

5. The powder composition of claim 1, further comprising up to 10% by weight of alloying elements.

6. The powder composition of claim 5, wherein the alloying elements are selected from the group consisting of Mn, Cu, Ni, Cr, Mo, V, Co, W, Nb, Ti, Al, P, S and B.

7. A method for preparing high density green compacts comprising the following steps:

(a) providing an iron-based powder composition of claim 1;

(b) uniaxially compacting the powder in a die at a compaction pressure of at least about 800 MPa; and (c) ejecting the green body.

* * * * *